US006481143B2

(12) United States Patent
McCarthy

(10) Patent No.: US 6,481,143 B2
(45) Date of Patent: Nov. 19, 2002

(54) GUN STOCK WITH RECOIL REDUCTION DEVICE

(76) Inventor: Patrick M. McCarthy, 18227 Goudy Rd., Dalton, OH (US) 44618

( * ) Notice: Subject to any disclaimer, the term of this patent is extended or adjusted under 35 U.S.C. 154(b) by 0 days.

(21) Appl. No.: 09/921,058

(22) Filed: Aug. 2, 2001

(65) Prior Publication Data

US 2002/0053156 A1 May 9, 2002

Related U.S. Application Data

(63) Continuation-in-part of application No. 09/705,328, filed on Nov. 3, 2000.

(51) Int. Cl.[7] ..... F41C 23/00
(52) U.S. Cl. ..... 42/74; 42/71.01
(58) Field of Search ..... 42/74, 73, 71.01; 89/44.01

(56) References Cited

U.S. PATENT DOCUMENTS

| | | | | | |
|---|---|---|---|---|---|
| 3,707,797 | A | * | 1/1973 | Ruth | 42/74 |
| 3,714,726 | A | * | 2/1973 | Braun | 42/74 |
| 3,754,344 | A | * | 8/1973 | Spiliotis | 42/74 |
| 3,795,998 | A | * | 3/1974 | Kuhl | 42/74 |
| 4,439,943 | A | * | 4/1984 | Brakhage | 42/74 |
| 4,910,904 | A | * | 3/1990 | Rose | 42/73 |
| 5,031,348 | A | * | 7/1991 | Carey | 42/71.01 |
| 5,375,360 | A | * | 12/1994 | Vatterott | 42/74 |
| 5,392,553 | A | * | 2/1995 | Carey | 42/73 |
| 5,410,833 | A | * | 5/1995 | Paterson | 42/73 |
| 5,974,718 | A | * | 11/1999 | Bentley et al. | 42/73 |

FOREIGN PATENT DOCUMENTS

| | | | | |
|---|---|---|---|---|
| IT | 300129 | * | 8/1932 | |
| IT | 355783 | * | 1/1938 | 42/74 |
| SU | 964433 | * | 10/1982 | |

* cited by examiner

*Primary Examiner*—Michael J. Carone
*Assistant Examiner*—Troy Chambers
(74) *Attorney, Agent, or Firm*—Sand & Sebolt

(57) ABSTRACT

A recoil reduction device for a gun includes a gun stock having forward and rear portions that move with respect to each other. Recoil reduction springs are disposed between the movable portions of the stock to absorb the recoil force. The springs are disposed around pins that extend rearwardly from a block. The pins include stops that limit the movement of the rear portion of the stock. The stops may also be used in combination with a recoil reduction lock and a secondary recoil reduction device.

17 Claims, 16 Drawing Sheets

GUN STOCK WITH RECOIL REDUCTION DEVICE

CROSS REFERENCE TO RELATED APPLICATIONS

This application is a continuation-in-part application of U.S. patent application Ser. No. 09/705,328 filed Nov. 3, 2000, titled Lock for a Gun Stock Recoil Reduction Device; the disclosures of which are incorporated herein by reference.

BACKGROUND OF THE INVENTION

1. Technical Field

The invention relates generally to recoil reduction devices for guns and, more particularly, to a recoil reduction device wherein the gun stock has forward and rear portions that move with respect to each other. Recoil reduction springs are disposed between the two portions to absorb the recoil force.

2. Background Information

When a gun is to be fired, the user brings the butt of the gun up to his shoulder so that a firm surface is provided to support the gun. The firing of the weapon produces a recoil that is mostly transmitted back into the shooter's shoulder. Sport shooters who shoot hundreds or thousands of shells each month desire to reduce this recoil force by outfitting their guns with recoil reduction devices.

Many different types of recoil reduction devices are known in the art. These devices include mechanisms having a spring extending between the body and butt of the gun. The spring is configured to absorb a portion of the recoil when a shell is discharged. The problem with this type of mechanism is that the user often unintentionally compresses the spring as he snaps the gun up to his shoulder. The unintentional compression is often experienced by trap, skeet, and sporting clays sportsmen. The compression of the spring at this stage is undesirable because the user does not achieve a tight, secure mount against his shoulder. In addition, the unintentional compression of the spring can reduce the effectiveness of the recoil reduction device.

One such mechanism is disclosed in U.S. Pat. No. 5,491,917 granted to Dilhan. This patent discloses the use of a honeycomb type of shock absorber which collapses as the launch cylinder moves rearwardly after the projectile is launched. Vironda, U.S. Pat. No. 3,461,589, discloses the use of an inertia member positioned in a gun stock and held in place by a magnet. The system includes a check valve and spring to rapidly re-position the inertia member so that additional shells can be shot from the gun. Heitz, U.S. Pat. No. 5,339,789 discloses the use of a locking mechanism which aids in absorbing the recoil energy from the discharge of the gun.

U.S. Pat. No. 5,410,833 granted to Paterson on May 2, 1995, which patent is incorporated herein by reference, discloses a mechanism for absorbing the energy from the recoil of a gun by using parallel compression struts which are mounted between the body and butt of the gun. One of the struts includes a cylinder which is connected at one end to the butt of the gun. A shaft, which is connected at one end to the body of the gun, is receivable within the cylinder. A moveable plug is further included in the cylinder and the plug includes a strut which is adapted for longitudinal axial movement within the cylinder. A plurality of compressible disc-shaped springs are disposed in the cylinder between the plug and the butt of the gun. The springs are coaxially disposed in the shaft, around the strut, so that as the strut moves within the cylinder the strut can reciprocate through the central apertures of the spring. As the gun fires, the butt of the gun is compressed against the user's shoulder—telescoping the shaft further inside the cylinder. This compresses the springs, thereby absorbing the recoil energy.

SUMMARY OF THE INVENTION

The invention provides a recoil reduction device for a gun that absorbs the recoil force created when the gun is fired. The recoil reduction device works with a gun stock having forward and rear portions that move relative to each other. The device places recoil reduction springs between the two moveable stock elements.

In one embodiment of the invention, a block is carried by each portion of the stock. A pair of pins extend from one of the blocks. The pins slide through the other block and the springs are disposed between the blocks. The pins also carry stops that limit the rearward movement of the rear portion of the stock.

The recoil reduction device may also be used with a recoil reduction lock and a secondary recoil reduction.

BRIEF DESCRIPTION OF THE DRAWINGS

The preferred embodiment of the invention, illustrative of the best mode in which applicant contemplated applying the principles of the invention, is set forth in the following description and is shown in the drawings and is particularly and distinctly pointed out and set forth in the appended Claims.

Similar numerals refer to similar parts throughout the specification.

DETAILED DESCRIPTION OF THE DRAWINGS

Figure 1:
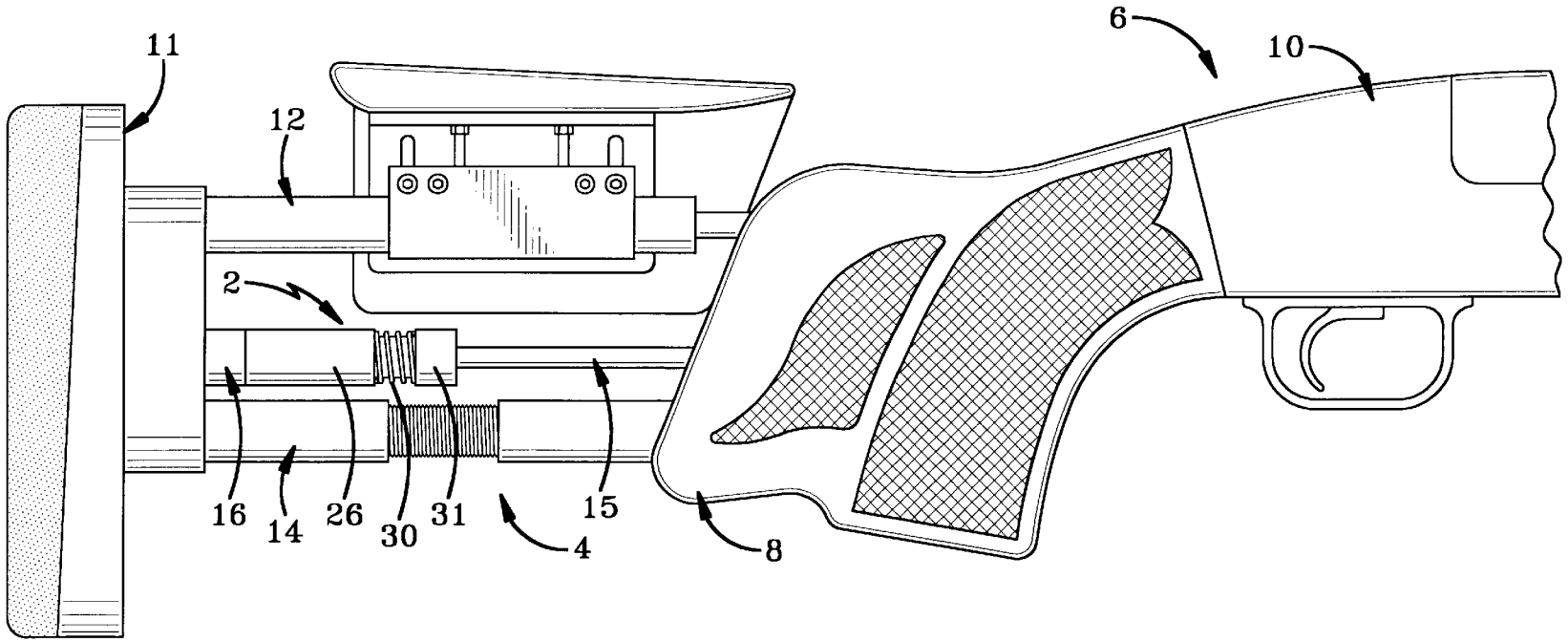
FIG. 1 is a front elevation view of the recoil reduction lock installed in a gun stock with a recoil reduction device.

The lock of the present invention is indicated generally by the numeral 2 in the accompanying drawings. Lock 2 prevents a recoil reduction device 4 from compressing until the gun 6 is discharged. Lock 2 is disposed in the gun stock 8 in cooperation with device 4.

Gun 6 includes a gun body 10 and a stock butt 11. Butt 11 is connected to the body 10 with the struts 12, 14 of recoil reduction device 4. The structure and operation of device 4 is disclosed in Paterson. Although Paterson discloses the use of a series of aligned bent plate springs to absorb the recoil, the drawings showing a coil spring 13 (FIG. 5A) that absorbs the recoil force. Lock 2 of the invention may be used with essentially any recoil reduction device 4 of this type and the Paterson device is disclosed only to provide an example.

Figure 2:
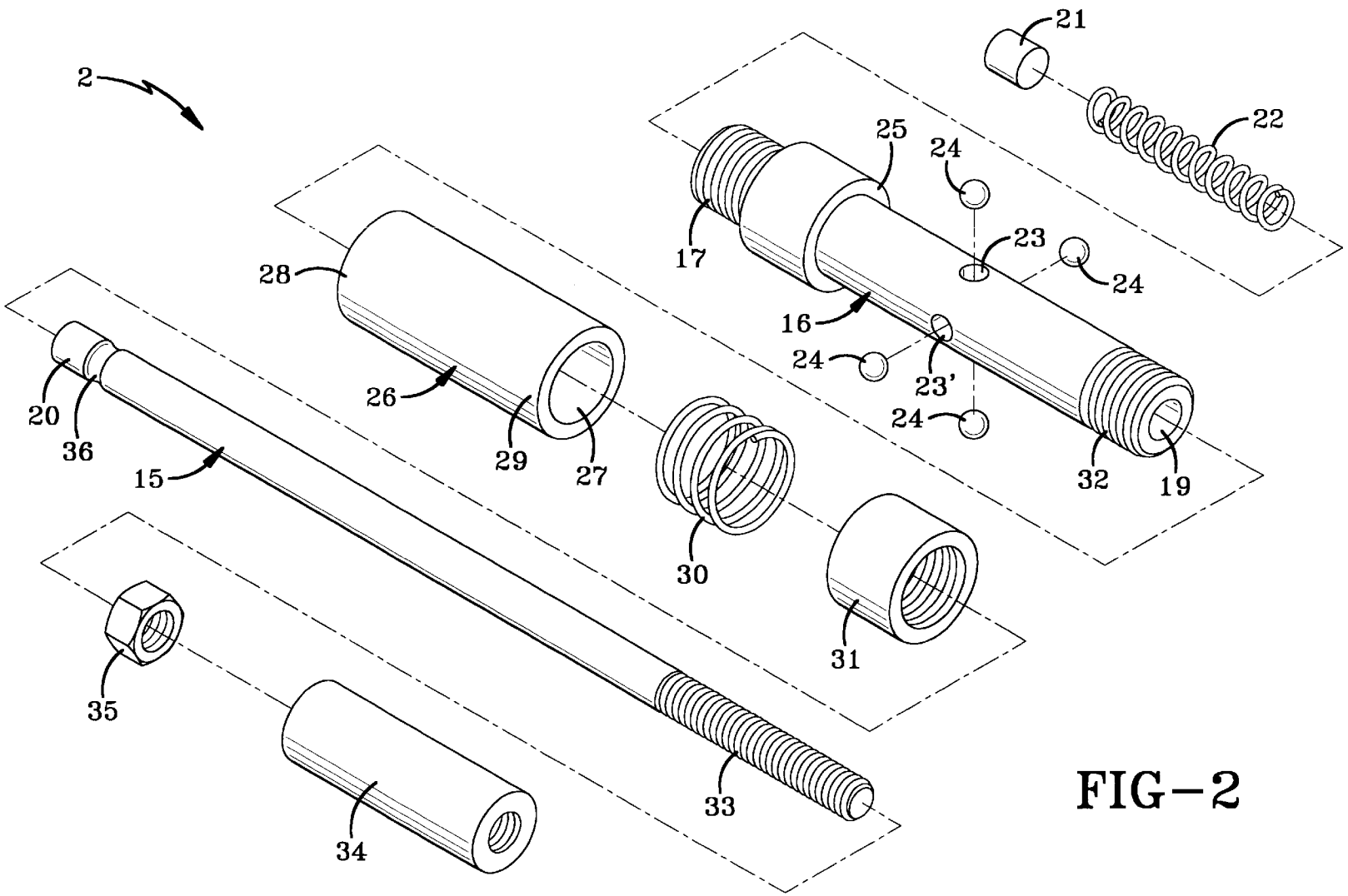
FIG. 2 is an exploded view of the recoil reduction lock.
Figure 3:
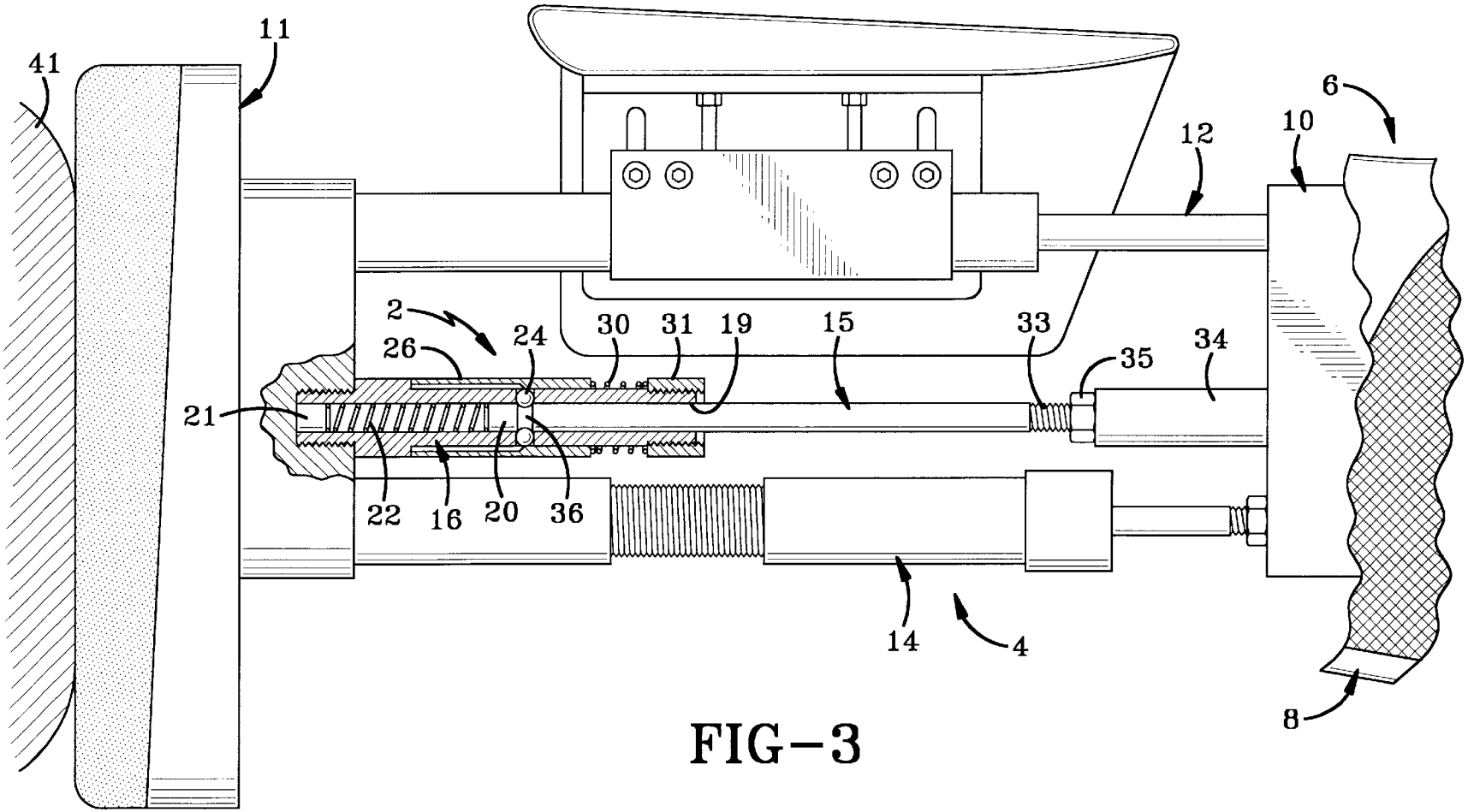
FIG. 3 is a front elevation view with a portion of the recoil reduction lock in section.

Referring to FIGS. 1, 2 and 3, lock 2 is connected at one end to body 10 of gun 6 and at its other end to butt 11 of the gun 6. Lock 2 generally includes a first member adapted to be connected to body 10 and a second member adapted to be connected to butt 11. A locking arrangement prevents the members from moving relative to each other before gun 6 is fired. Immediately after gun 6 is fired, the locking arrangement moves to an unlocked position to allow the members to move relative to each other. The locking arrangement is operated by using the recoil force generated by gun 6 when gun 6 is fired. The locking arrangement may thus include an inertia-type lock.

The first member of the exemplary embodiment of lock 2 is a shaft 15 having a first end and a second end. The second end of shaft 15 is adapted to be disposed closely adjacent or attached to body 10 of gun 6. The first end of shaft 15 is selectively slidably received in the second member of lock 2. In the exemplary embodiment, the second member of lock 2 is a sleeve 16. Sleeve 16 is adapted to be connected to butt 11 of gun 6.

Referring to FIG. 2, the first end 17 of first sleeve 16 is externally threaded and is adapted to be received into an internally threaded recess 18 in butt 11 of gun 6. In other embodiments of the invention, first sleeve 16 may be connected to butt 11 is other manners known to those skilled in the art. A longitudinal bore 19 is defined by first sleeve 16, and the first end 20 of shaft 15 is slidably received within bore 19. A stopper 21 and first spring 22 are disposed within bore 19 proximate first end 17 of first sleeve 16. Stopper 21 engages the interior of butt 11 (FIG. 3) and provides a firm surface against which the first spring 22 may be compressed. In other embodiments, spring 22 may directly engage butt 11 or bore 19 may be closed off adjacent end 17. First end 20 of shaft 15 engages first spring 22 in bore 19.

First sleeve 16 defines two passages 23, 23' disposed substantially perpendicular to bore 19 and substantially perpendicular to each other. Other numbers of passages and different angles of interaction of the passages are within the scope of this invention. Passages 23, 23' are adapted to receive ball bearings 24 in a manner that allows ball bearings 24 to slide radially inwardly and radially outward with respect to first sleeve 16.

First sleeve 16 further includes a step or shoulder 25 proximate first end 17. Shoulder 25 may be formed as an integral part of first sleeve 16 or may be a housing receivable over first sleeve 16 and secured against longitudinal motion in a suitable manner.

Figure 3A:
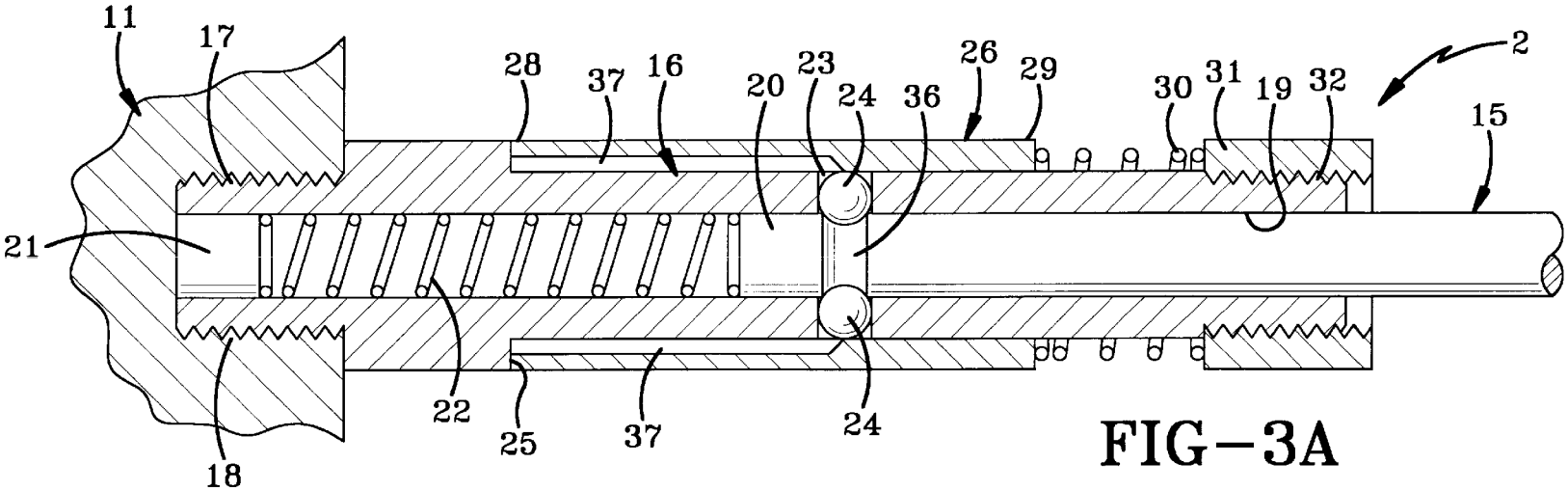
FIG. 3A is an enlarged cross sectional view of the lock in the locked position.
Figure 4B:
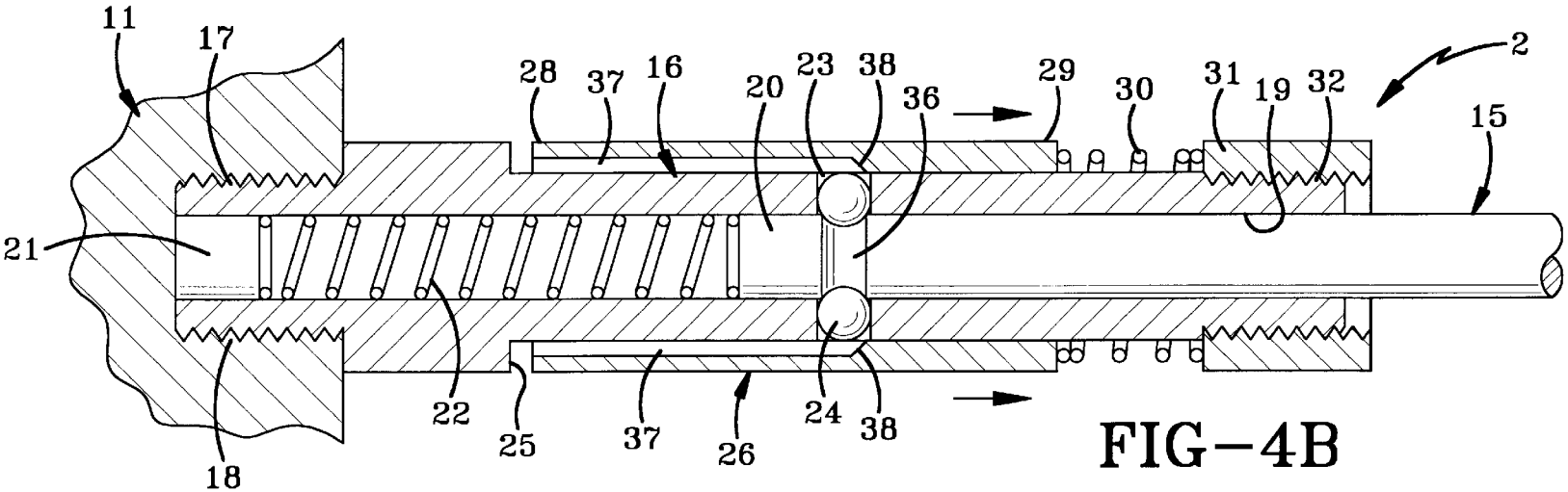
FIG. 4B is an enlarged cross sectional view of the lock in the unlocked position.
Figure 5:
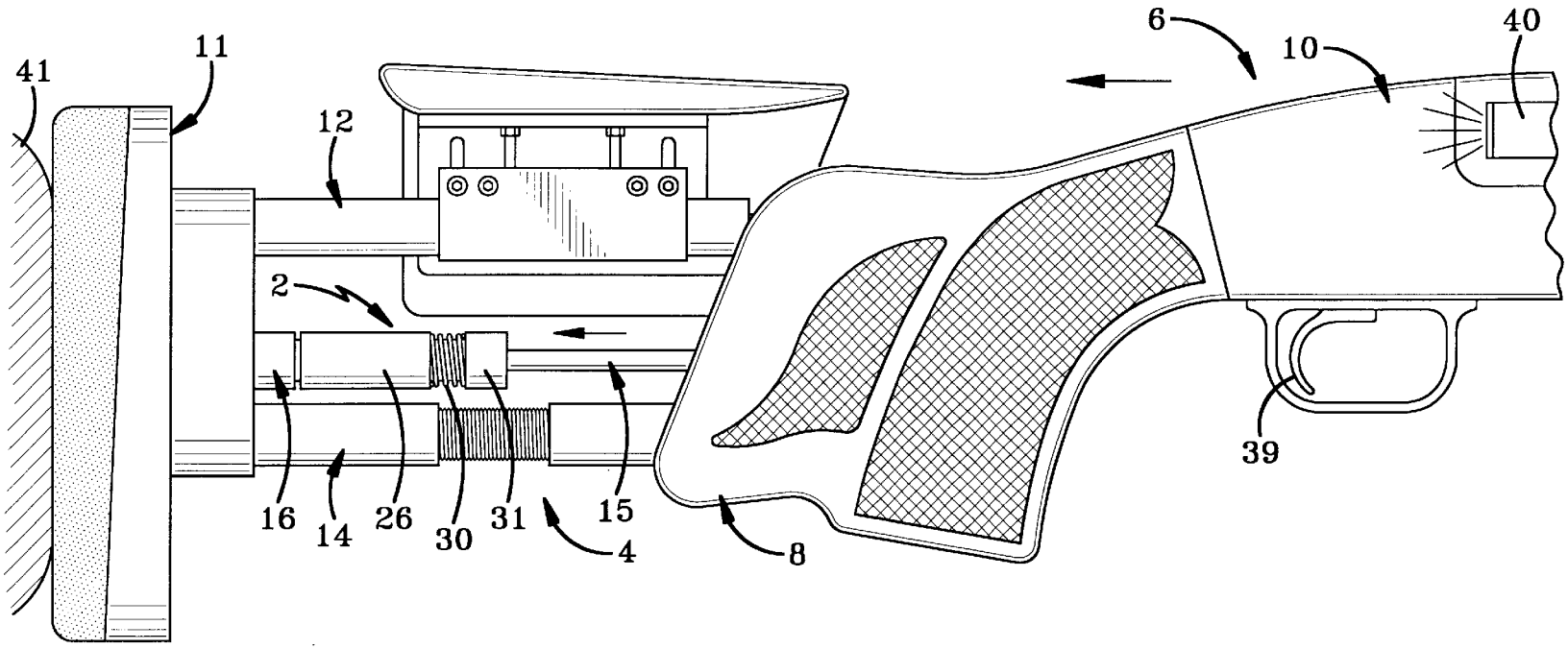
FIG. 5 is a front elevation view of the gun showing the recoil reduction device absorbing the recoil force.

A second sleeve 26 having an internal bore 27 is longitudinally and coaxially disposed around first sleeve 16. Second sleeve 26 is movable between locked (FIGS. 3A and 6B) and unlocked positions (FIGS. 4B and 5B). Second sleeve's internal bore 27 varies in diameter, having a greater diameter proximate the first end 28, and a lesser diameter proximate the second end 29 as shown in FIG. 3A. First end 28 of second sleeve 26 is adapted to abut shoulder 25 of first sleeve 16 and second end 29 engages a compression spring 30. An internally threaded nut 31 is provided to engage the externally threaded second end 32 of sleeve 16 thereby securing second sleeve 26 and compression spring 30 around first sleeve 16. A circumferential space 37 is disposed between first sleeve 16 and the section of larger diameter of second sleeve 26. An incline 38 is formed between the areas of greater and lesser diameter of the bore 27.

Shaft 15 defines a circumferential groove 36 proximate first end 20. Groove 36 is configured to seat ball bearings 24 in a position where ball bearings 24 are positioned in groove 36 and in passages 23, 23'. Groove 36 and incline 38 are positioned such that ball bearings 24 engage second sleeve 26 immediately adjacent incline 38 when second sleeve 26 is in the locked position.

In one embodiment of the invention, the second end 33 of shaft 15 is externally threaded and engages an internally threaded housing 34 and is secured therein by a locking nut 35. Housing 34 is secured to body 10 of gun 6 by any suitable means (not shown) such as threads, an interference fit, a frictional fit, an abutment, or the like. The length of shaft 15 may be adjusted by rotating nut locking 35 to cause the shaft to move longitudinally relative to housing 34. The adjustability of shaft 15 allows lock 2 to be used with different stocks 8 known in the art.

The device of the present invention works in the following manner.

Referring to FIG. 3A—when gun 6 is in the "at rest" position and lock 2 is in the locked position, first end 28 of the second sleeve 26 abuts shoulder 25. In this position, ball bearings 24 engage groove 36 of shaft 15 and the lesser diameter surface of second sleeve 26. This engagement locks second sleeve 26 and shaft 15 together. The ball bearings 24 disposed in the groove 36 are positioned immediately adjacent incline 38, but in the at rest position, ball bearings 24 are prevented from entering the space 37 between the first and second sleeves 16, 26. In this position, shaft 15 cannot slide with respect to first sleeve 16 and recoil reduction device 4 cannot be compressed. The shooter thus does not unintentionally compress stock 8 when the shooter quickly mounts stock 8 to his shoulder 41 (FIG. 3).

Figure 4:
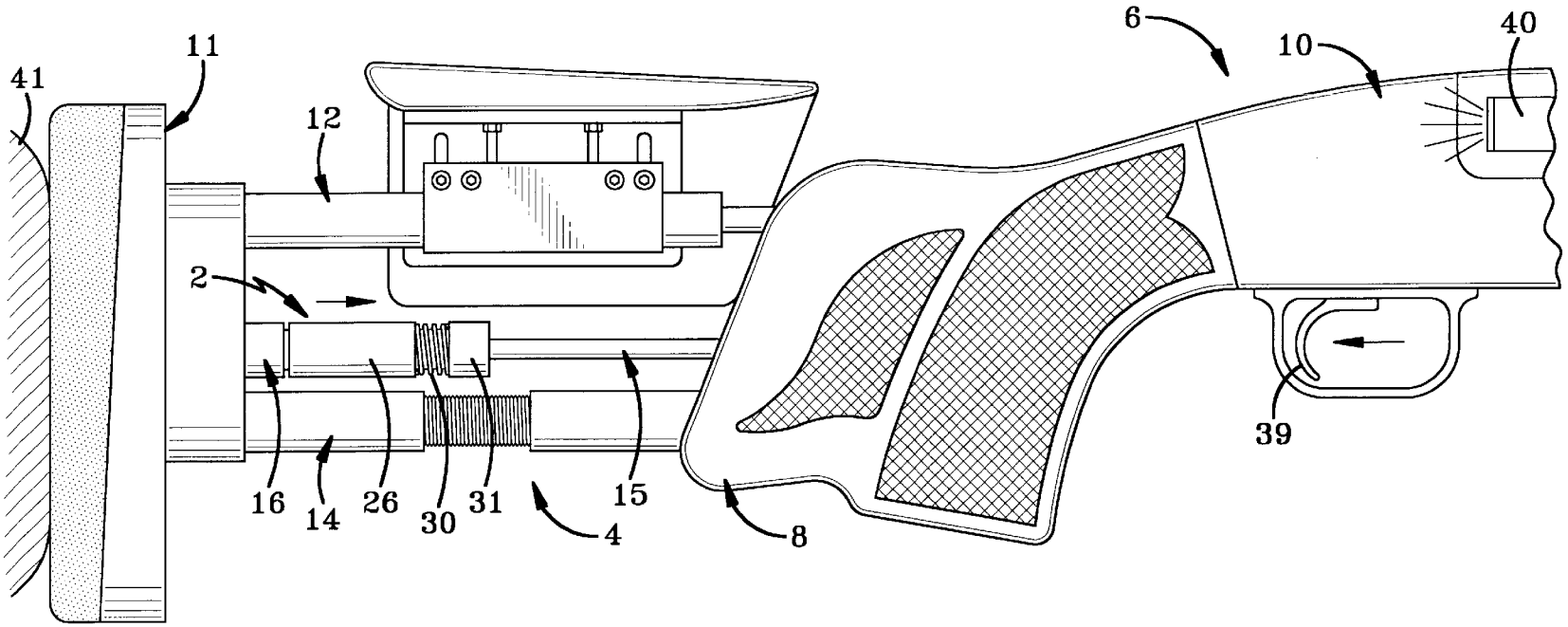
FIG. 4 is a front elevation view of the lock being moved to the unlocked position upon the discharge of a shell in the chamber.
Figure 4A:
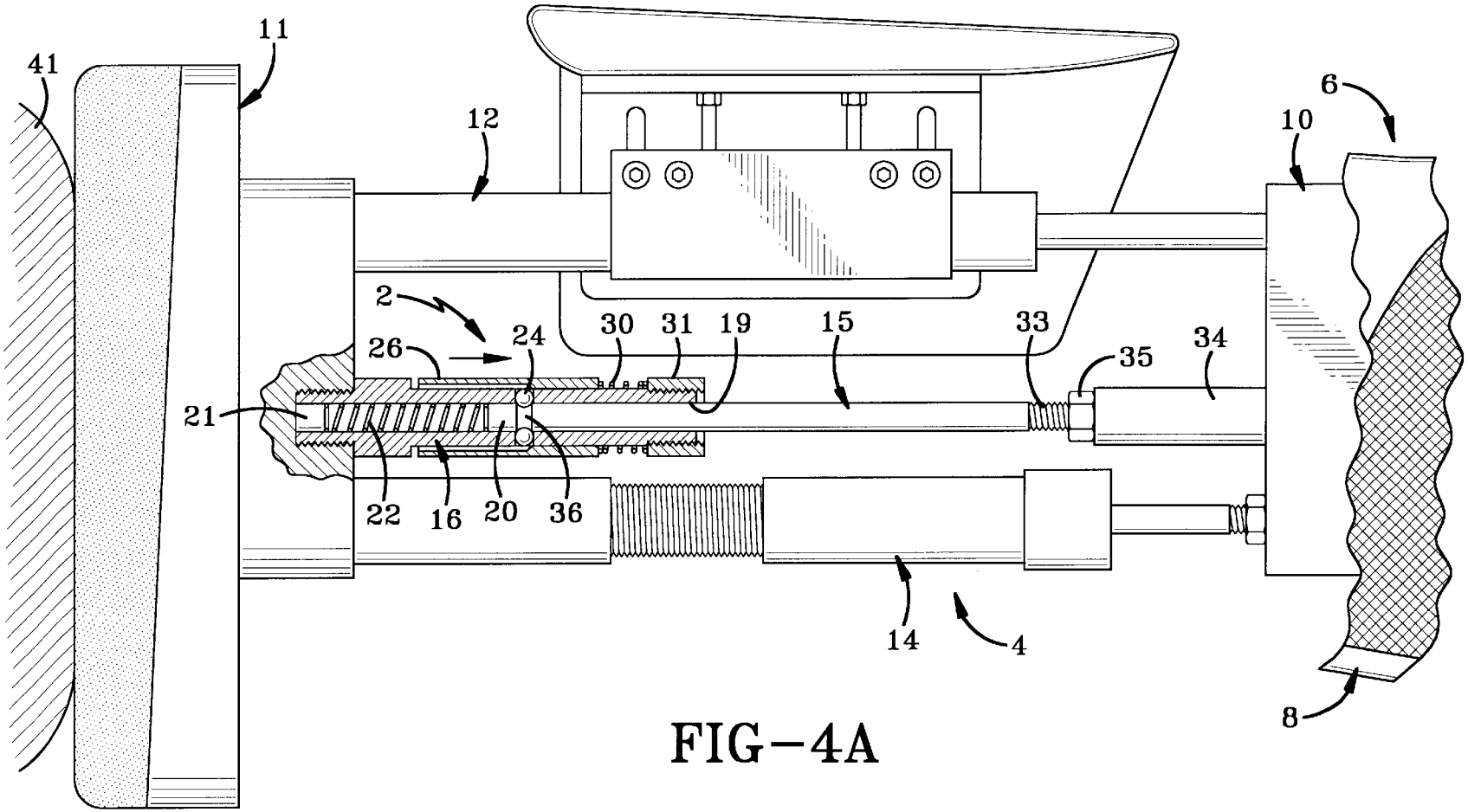
FIG. 4A is a cross sectional view of the lock in the unlocked position.

When the trigger 39 is squeezed by the shooter, a shell 40 is fired from gun 6 as shown in FIG. 4. The explosion of shell 40 immediately forces gun 6 rearwardly with a recoil force and releases lock 2 so that recoil reduction device 4 may be compressed to absorb the recoil force. Lock 2 is released because second sleeve 26 is not secured to the first sleeve 16. The shock force of the explosion forces sleeve 26 relatively forward (compared to first sleeve 16) into an unlocked position as shown in FIGS. 4, 4A, and 4B. The movement is relative because sleeve 26 actually remains substantially stationary while gun 6 recoils rearwardly. Sleeve 26 remains substantially stationary because of its inertia and sliding arrangement. Sleeve 26 may thus be described as an inertia lock.

Figure 5A:
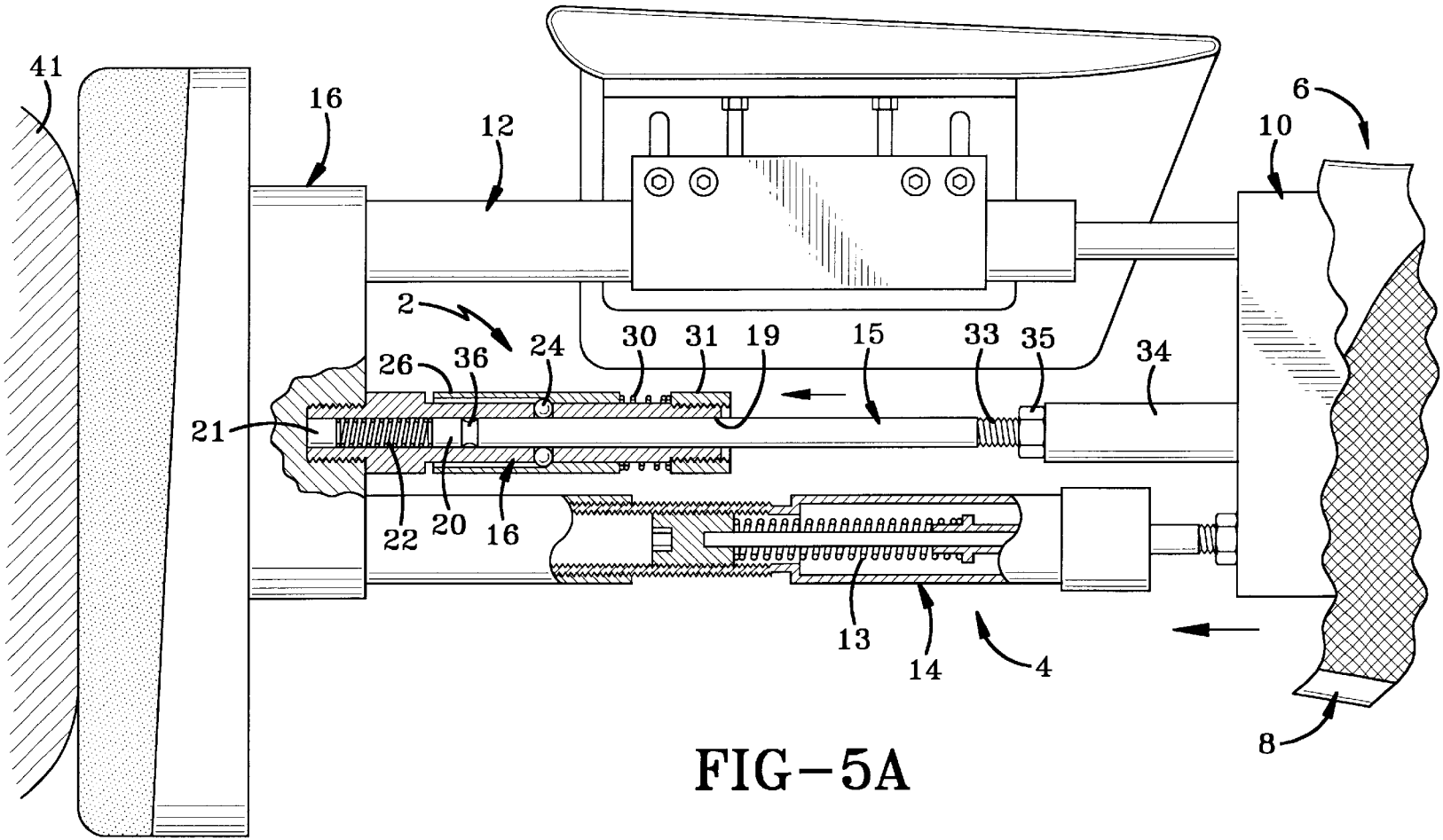
FIG. 5A is a cross sectional view of the recoil reduction device absorbing the recoil force.
Figure 5B:
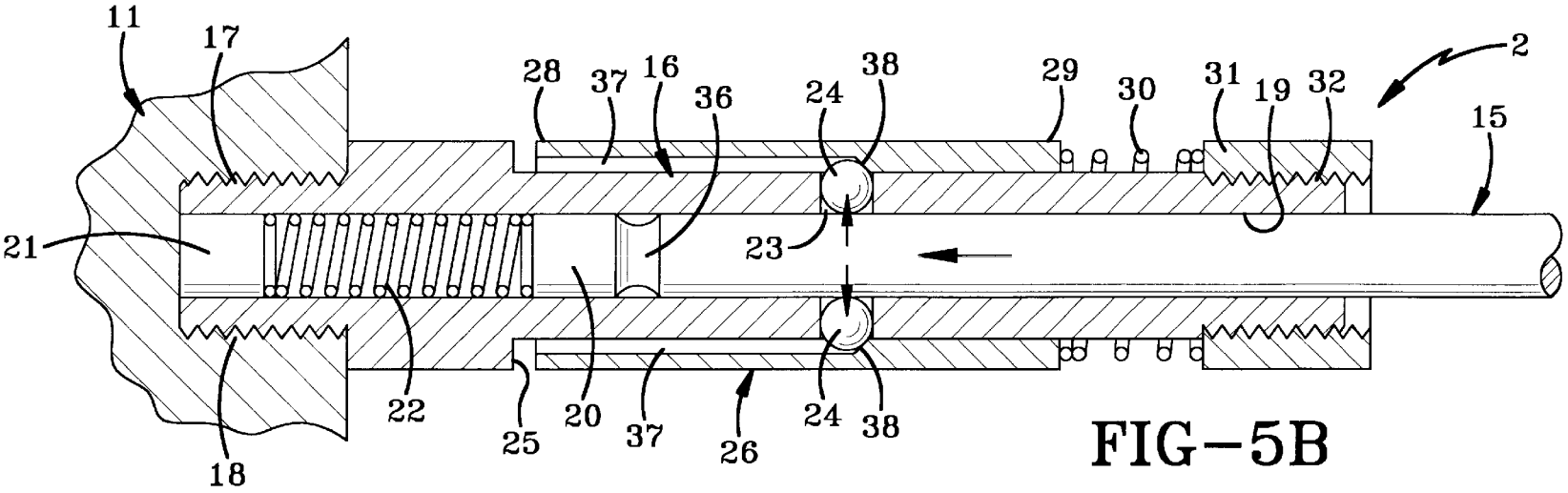
FIG. 5B is an enlarged sectional view of the lock.

Immediately after sleeve 26 moves, shaft 15 moves rearwardly (FIG. 5) and forces ball bearings outwardly along incline 38 into space 37 as shown in FIGS. 5A and 5B. Space 37 is not large enough to fully receive bearing 24 such that ball bearings 24 remain seated in passages 23,23'. Ball bearings 24 are then free of groove 36 allowing shaft 15 to slide relative to first sleeve 16. Shaft 15 may then freely compress spring 22 and allow recoil reduction device 4 to compress and absorb the recoil force in spring 13 (FIG. 5A). The release occurs immediately after gun 6 is fired.

Figure 6B:
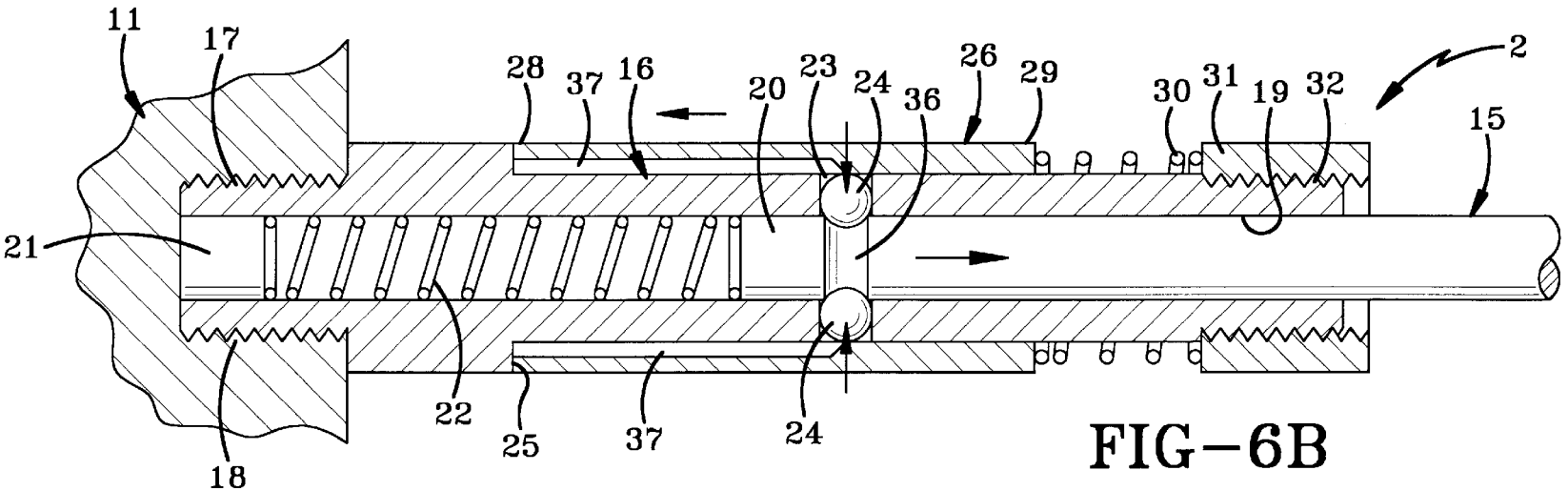
FIG. 6B is an enlarged section of the lock in the locked position.
Figure 6:
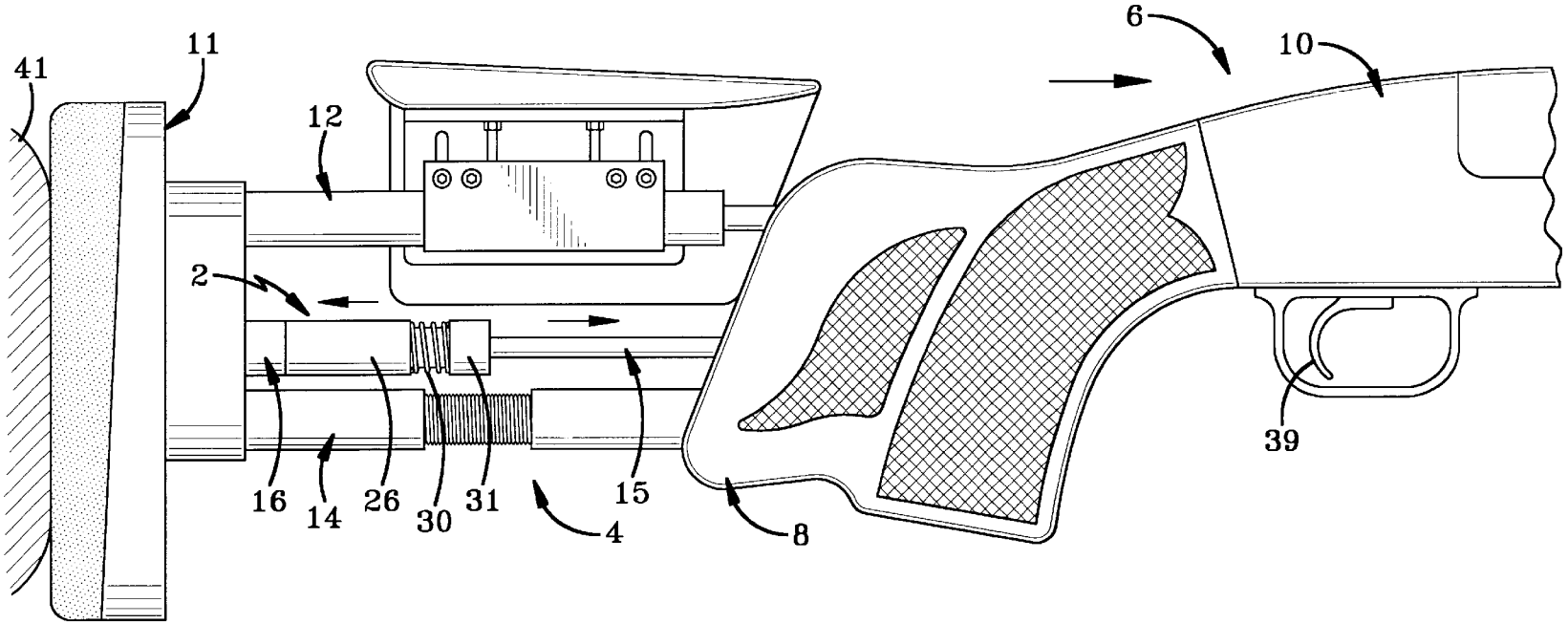
FIG. 6 is a front elevation view of the recoil reduction device expanding after it has absorbed the recoil force and to move the inertia lock back to the locked position.
Figure 6A:
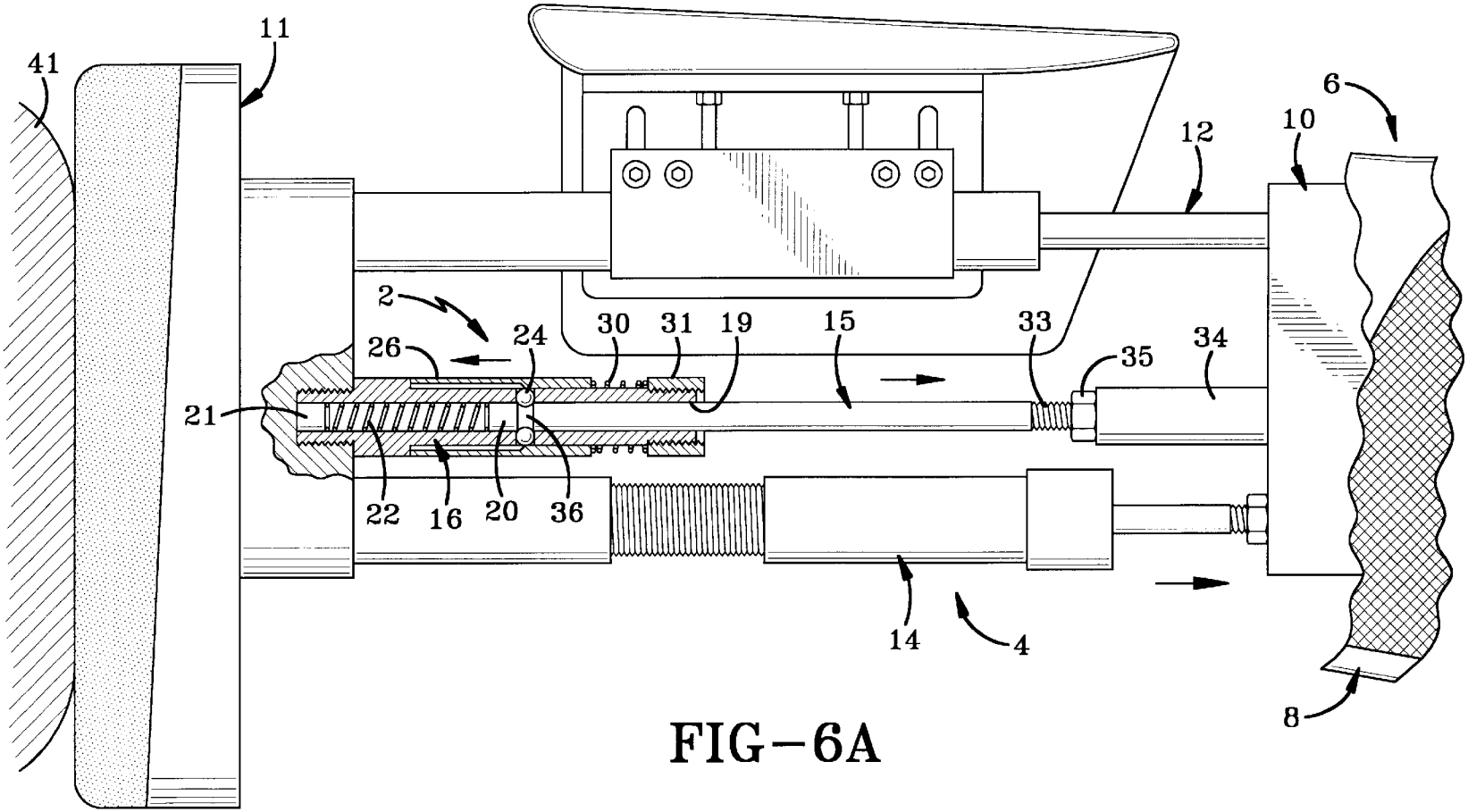
FIG. 6A is a sectional view of the inertia lock after it has moved back into the locked position.

As second sleeve 26 moves forward towards body 10 of gun 6, it compresses compression spring 30 against nut 31. Spring 13 of recoil reduction device 4 then expands forcing stock 8 apart and moving shaft 15 back through sleeve 16 (FIGS. 6 and 6A). Compression spring 30 and spring 22 then begin to expand helping reset lock 2 so that stock 8 with be locked again. As second sleeve 26 moves rearwardly, ball bearings 24 are forced back up incline 38 to the locked position as shown in FIG. 6B. Ball bearings 24 slide back into engagement with groove 36 and shaft 15 is once again held in the locked position.

Figure 7:
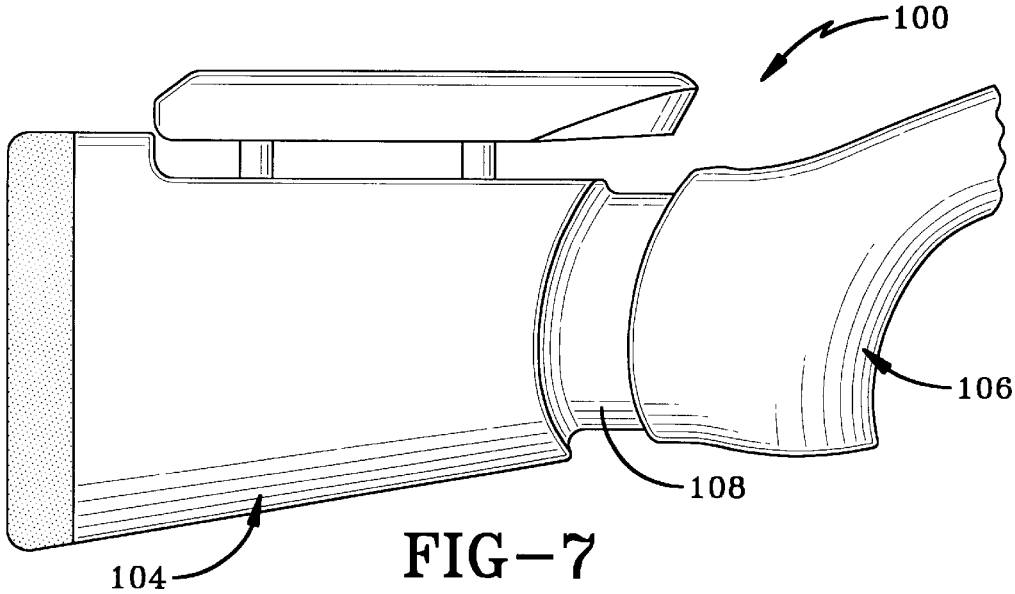
FIG. 7 is a front elevation view of a gun stock having the improved recoil reduction device of the present invention.
Figure 9:
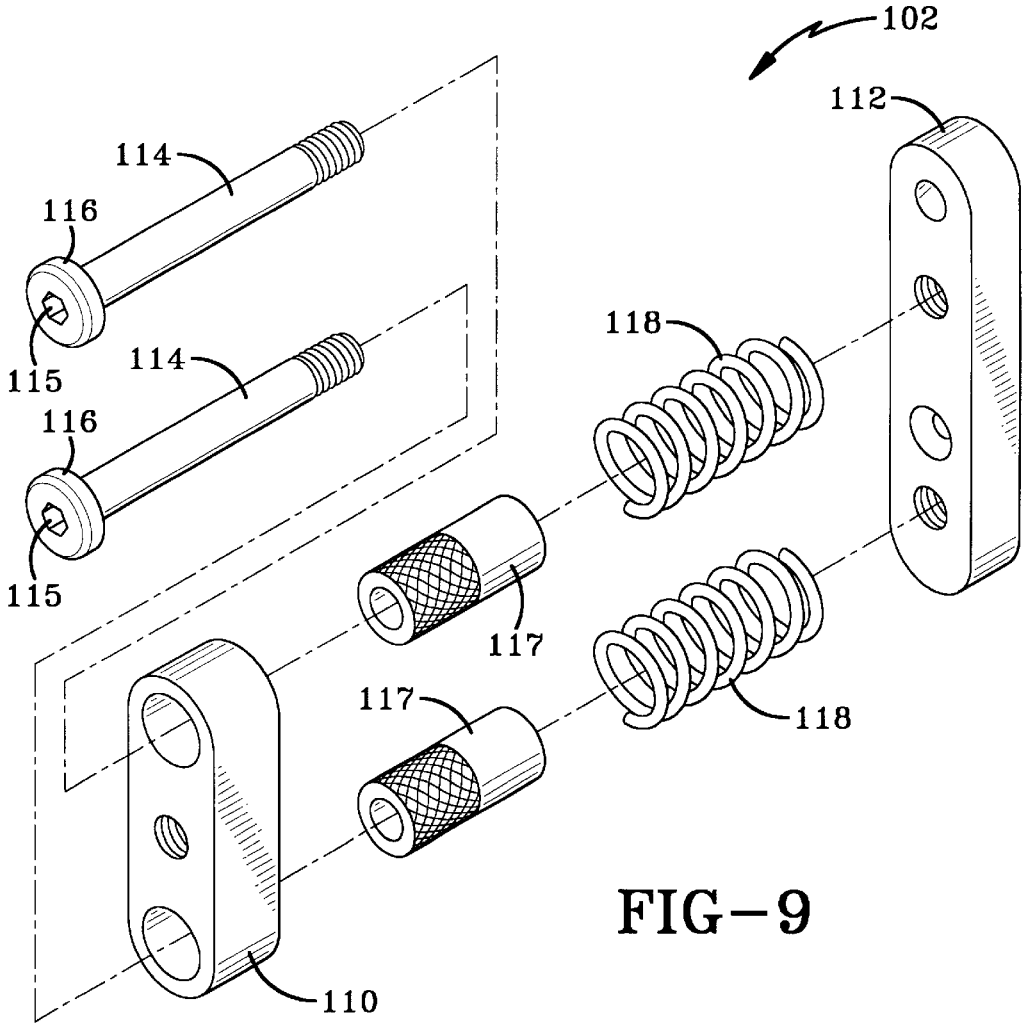
FIG. 9 is an exploded view of the recoil reduction device that is disposed in the gun stock of FIG. 7.

FIG. 7 depicts an alternative gun stock 100 having an improved recoil reduction device 102 that absorbs a significant portion of the recoil force generated by an exploding shell. Gun stock 100 includes a rear portion 104 and a forward portion 106 that move relative to one another. In one embodiment, forward portion 106 slides back over rear portion 104 when the gun is fired while allowing recoil reduction device 102 to absorb the recoil force. In other embodiments, forward portion 106 slides back into rear portion 104. Forward portion 106 defines a cavity 107 that receives a portion of the forwardly-facing nose 108 of rear portion 104. Nose 108 is sized to fit within cavity 107 without frictionally engaging forward portion 106. Gun stock 100 is configured to look similar to a standard gun stock by completely surrounding the elements of recoil reduction device 102.

Figure 8:
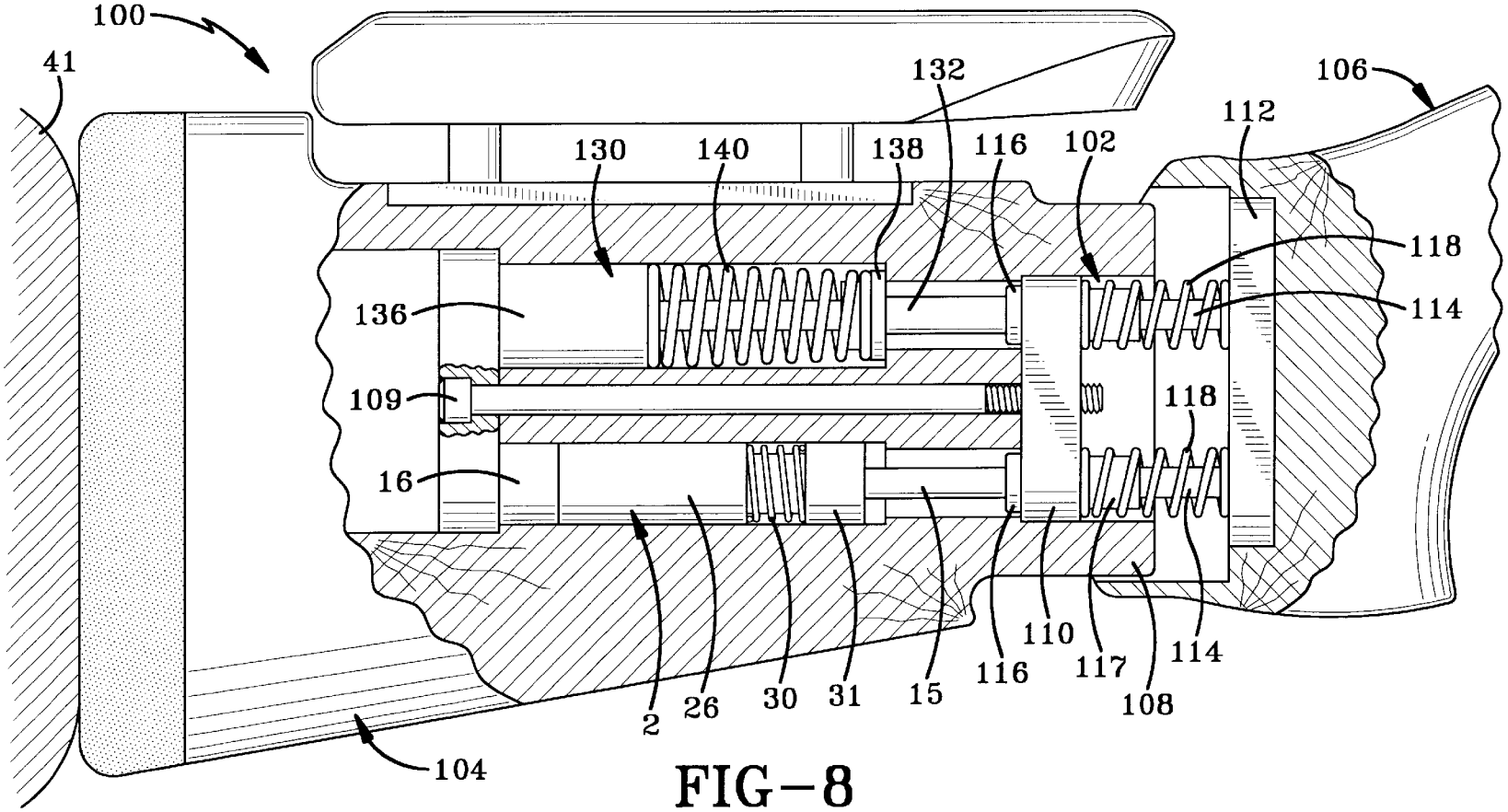
FIG. 8 is a view similar to FIG. 7 with portions of the gun stock broken away to show the components of the recoil reduction device of the invention.
Figure 8A:
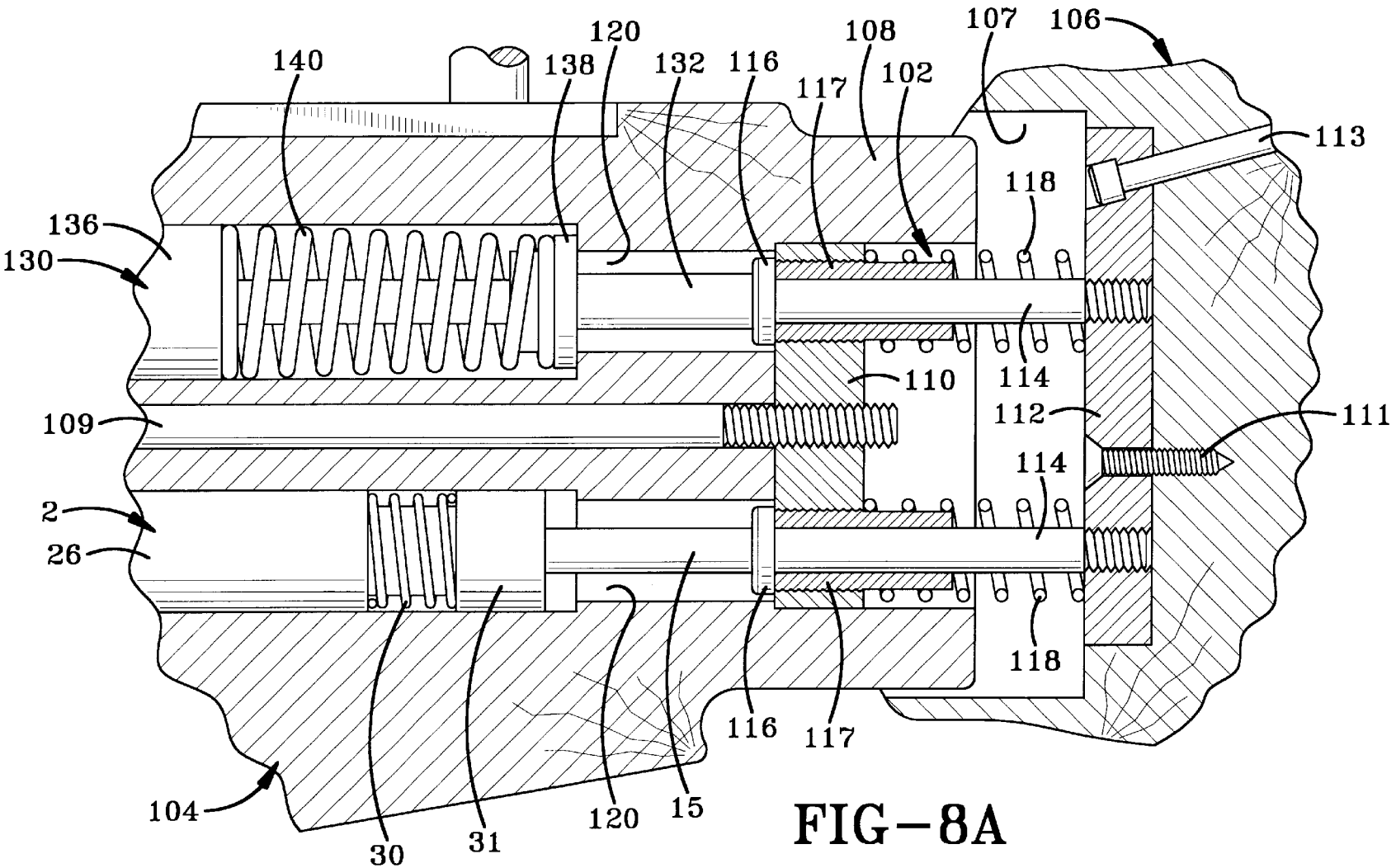
FIG. 8A is a view similar to FIG. 8 with the elements of the improved recoil reduction device depicted in section.

Recoil reduction device 102 includes a rear block 110 connected to rear portion 104 and a forward block 112 connected to forward portion 106. Forward block 112 may be connected to forward portion 106 with an appropriate connector such as the wood screw 111 and the bolt 113 shown in FIGS. 8A and 10A. Forward block 112 may be tightly seated in a opening defined in the front of cavity 107.

Rear block 110 may be connected to rear portion 104 by a bolt 109 that is accessible from the rear surface of rear portion 104. Rear block 110 may be tightly seated in a cavity that is defined by the front surface of rear portion 104.

A pair of pins 114 are connected to forward block 112 and extend rearwardly into rear portion 104 of gun stock 100. Rear portion 104 slides back and forth on pins 114. Pins 114 may be threaded into forward block 112 with a tight threaded connection. To facilitate this connection, the rear ends of each pin 114 may include wrench faces 115 that allow pin 114 to be rotated. A pair of spaced sleeves 117 are connected to rear block 110. Each sleeve 117 slides on a pin 114 without allowing rear block 110 to wobble or tilt with respect to forward portion 106. In one embodiment, each sleeve 117 may be fabricated from brass with each pin 114 being fabricated from stainless steel. Each sleeve 117 may be press fit or threaded into block 110.

A stop 116 is disposed at the rear end of each pin 114. Stops 116 limit the rearward movement of rear portion 104 by abutting rear block 110. The forward movement of rear portion 104 is limited by recoil springs 118 that are disposed between blocks 110 and 112. Springs 118 may be disposed around pins 114 and sleeves 117 or around pins 114 and portions of sleeves 117. Recoil springs 118 are sized to absorb substantially all of the recoil force generated by the gun.

Figure 10:
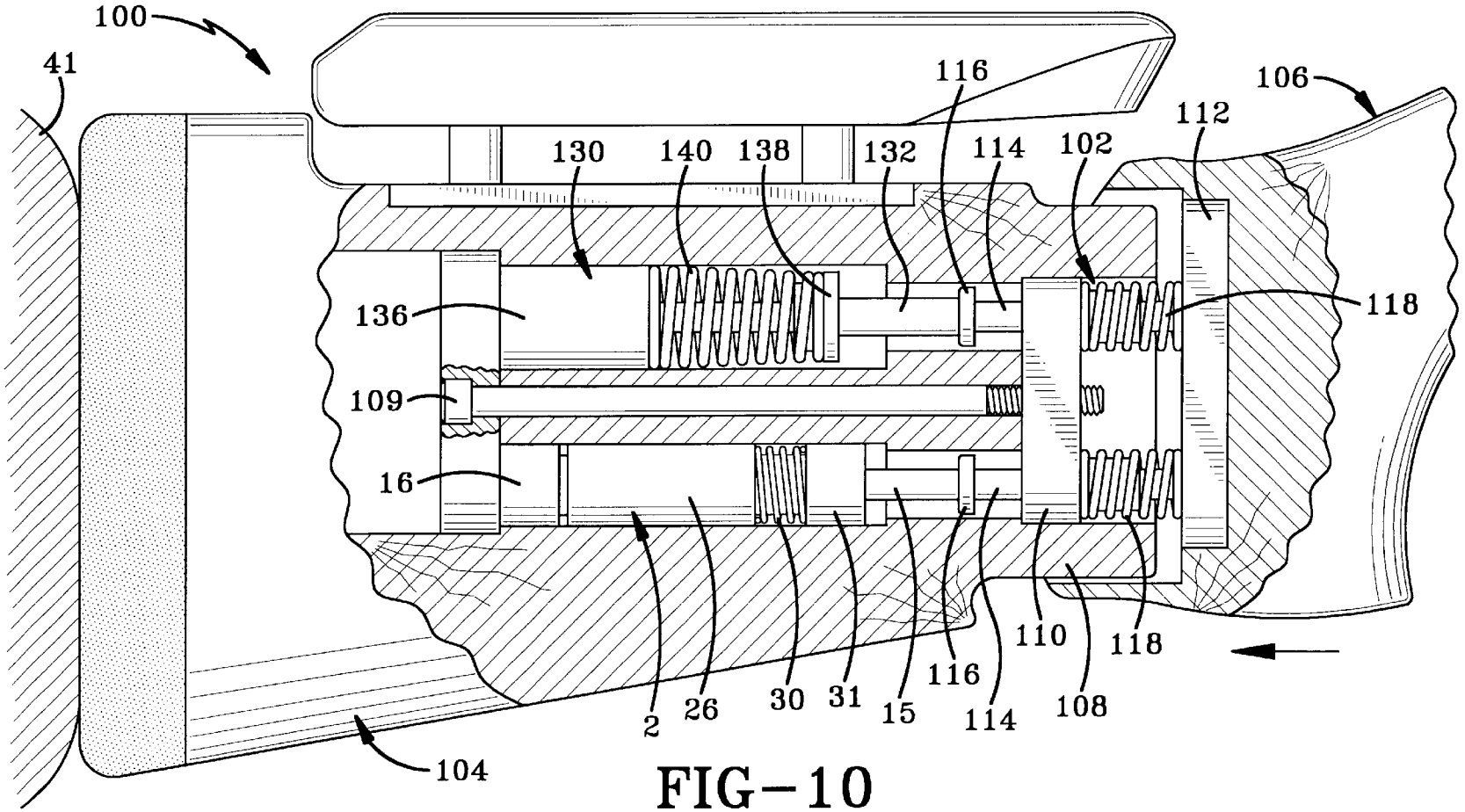
FIG. 10 is a view similar to FIG. 8 showing the recoil reduction device immediately after a shell has been discharged.
Figure 10A:
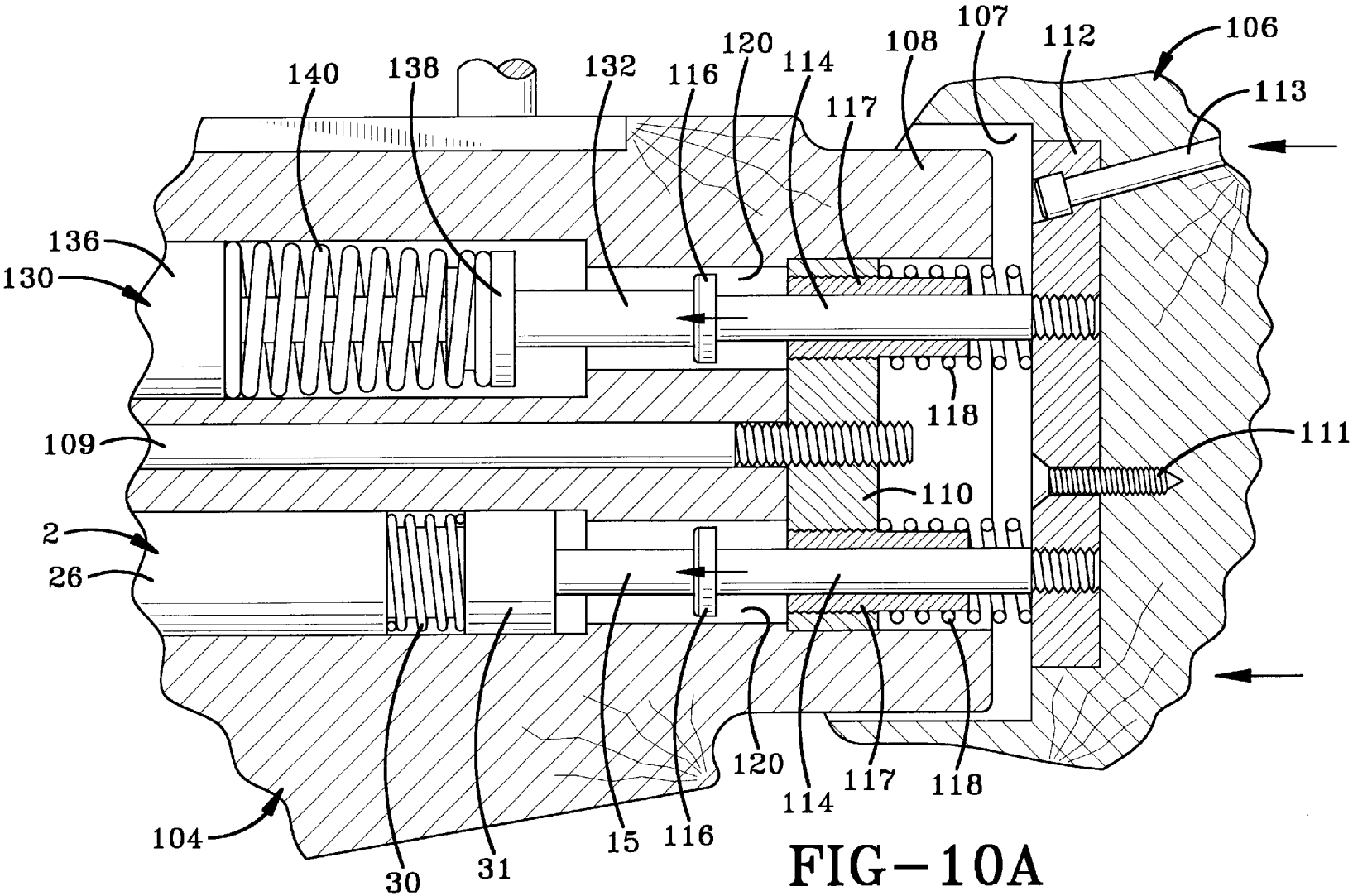
FIG. 10A is a view similar to FIG. 8A showing the FIG. 10 position of the elements in section.

Rear portion 104 defines openings 120 configured to receive stops 116 and pins 114 when springs 118 are compressed as depicted in FIGS. 10 and 10A.

When the gun is fired, the explosion creates a recoil force that forces forward portion 106 of stock 100 rearwardly. The rearward movement of forward portion 106 is permitted because pins 114 slide through sleeves 117 into openings 120. As forward portion 106 moves rearwardly, springs 118 compress to absorb the recoil force. When the recoil force is absorbed, springs 118 force forward portion 106 to return to its resting position.

Stock 100 and recoil reduction device 102 have the advantage over prior art recoil reduction stocks in that stock 100 may be fabricated to have an aesthetic appearance similar to standard, one-piece stocks that are preferred by those who purchase shotguns. Recoil reduction device 102 is compact and strong because the connections between blocks 110,112 and stock portions 104,106 are strong and tight.

Another advantage to recoil reduction device is that it may be used in combination with recoil reduction lock 2 described above. The second end of shaft 15 of lock 2 may abuttingly engage stop 16 of recoil reduction device 102 so that forward portion 106 of stock 100 cannot move rearwardly until lock 2 is moved to the unlocked position. Rear portion 104 may include a bore that receives lock 2. The diameter of the bore may be just slightly larger than the outer diameter of lock 2 so that lock 2 is supported by the body of rear portion 104.

In another embodiment of the invention, a secondary recoil reduction device 130 is carried by rear portion 104 to absorb recoil force and to help return lock 2 to the locked position. Secondary recoil reduction device 130 includes a first shaft 132 having a first end that is slidingly disposed in a sleeve 136. The second end of shaft 132 abuts stop 116. A flange 138 is carried by shaft 132. A spring 140 is disposed between sleeve 136 and flange 138. Spring 140 absorbs recoil force when lock 2 is unlocked and stop 116 pushes shaft 132 toward sleeve 136. Secondary recoil reduction device 130 may also be received in a bore defined by rear portion 104 with the diameter of the bore being just slightly larger than the outer diameter of device 130 so that device 130 is supported by the body of rear portion 104.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A recoil reduction device for a gun stock; comprising:

a forward stock portion;

a rear stock portion;

the forward and rear stock portions adapted to move relative to each other;

a pair of pins connected to the forward stock portion;

the rear stock portion sliding on the pins; and a recoil reduction spring carried on each pin between the forward portion and the rear portion.

2. The recoil reduction device of claim 1, further comprising a forward block connected to the forward stock portion and a rear block connected to the rear stock portion; the pins extending from the forward block through the rear block.

3. The recoil reduction device of claim 2, further comprising a pair of sleeves connected to the rear block; each pin being disposed through one of the sleeves.

4. The recoil reduction device of claim 3, wherein the sleeves are fabricated from brass.

5. The recoil reduction device of claim 4, wherein the pins are fabricated from stainless steel.

6. The recoil reduction device of claim 3, further comprising a stop connected to each pin; the rear block being disposed between the stops and the forward block.

7. The recoil reduction device of claim 1, wherein the forward stock defines a cavity and the rear stock portion defines a nose; a portion of the nose being disposed within the cavity.

8. The recoil reduction device of claim 1, further comprising a lock that prevents the recoil reduction device from compressing until the gun is fired.

9. The recoil reduction device of claim 8, further comprising a secondary recoil reduction device.

10. The recoil reduction device of claim 9, wherein the forward stock portion and the rear stock portion completely surround the lock and secondary recoil reduction device.

11. The recoil reduction device of claim 1, wherein the forward stock portion slides over the rear stock portion.

12. The recoil reduction device of claim 11, wherein the rear stock portion includes a nose that is at least partially disposed inside the forward stock portion.

13. The recoil reduction device of claim 1, wherein the forward stock portion and the rear stock portion completely surround the a pair of pins and the recoil reduction springs.

14. A recoil reduction device for a gun stock; comprising:

a forward stock portion;

a rear stock portion;

the forward and rear stock portions adapted to move relative to each other;

a forward block connected to the forward stock portion;

a rear block connected to the rear stock portion;

a pair of pins connected to the forward stock portion and extending through the rear block;

the rear stock portion sliding on the pins; and a recoil reduction spring carried on each pin between the forward and rear blocks.

15. The recoil reduction device of claim 14, further comprising a pair of sleeves connected to the rear block; each pin disposed through one of the sleeves.

16. The recoil reduction device of claim 14, further comprising a stop connected to each pin; the rear block being disposed between the stops and the forward block.

17. The recoil reduction device of claim 14, wherein the forward and rear portions of the stock completely surround the forward block, the rear block, the pins, and the recoil reduction springs.

* * * * *